US005412361A

United States Patent [19]

Combest et al.

[11] Patent Number: 5,412,361

[45] Date of Patent: May 2, 1995

[54] SOLDERLESS FLUSHMOUNT SECURITY PROXIMITY SWITCHES AND METHODS OF CONSTRUCTING AND UTILIZING SAME

[75] Inventors: Randy L. Combest; John O. Beck, both of Florence, Oreg.

[73] Assignee: Nascom, Inc., Newberg, Oreg.

[21] Appl. No.: 965,429

[22] Filed: Oct. 23, 1992

[51] Int. Cl.[6] ..... H01H 9/00

[52] U.S. Cl. ..... 335/205; 439/441

[58] Field of Search ..... 335/205, 206, 207, 151, 335/152, 153, 154; 439/439, 441, 404, 417

[56] References Cited

U.S. PATENT DOCUMENTS 4,371,856 2/1983 Holce et al. ..... 335/205

4,700,163 10/1987 Wolfe, Jr. ..... 335/205

4,978,315 12/1990 Edgley et al. ..... 439/441

5,019,705 5/1991 Patel et al. ..... 335/205

5,158,475 10/1992 Tyler ..... 439/439

*Primary Examiner*—Lincoln Donovan

*Attorney, Agent, or Firm*—Weiner, Carrier & Burt; Joseph P. Carrier; William F. Esser

[57] ABSTRACT

A security proximity switch used in burglar alarms comprising a magnet portion and a signal generating portion. The signal generating portion comprises a reed switch having a device for quickly and easily connecting external wiring thereto. This saves time and money. The device for quickly securing the wiring includes a spring device adapted to grasp and secure the inserted wiring.

5 Claims, 1 Drawing Sheet

SOLDERLESS FLUSHMOUNT SECURITY PROXIMITY SWITCHES AND METHODS OF CONSTRUCTING AND UTILIZING SAME

BACKGROUND OF THE INVENTION

1. Field of the Invention

The present invention relates to security proximity switches which are used in burglar alarms and other security alarms. More specifically, the present invention relates to magnetic switches having two components, a magnet and a reed switch. The magnet may preferably, but not necessarily, be positioned on a door or window. The reed switch may preferably, but not necessarily, be flush mounted to be positioned on the door jamb or window jamb opposite the magnet. The magnetic attraction of the magnet holds the reed of the reed switch in a closed position. When the magnet is removed from the proximity of the reed switch by opening the door or window, the "connection" opens and a signal is sent via external wires to a controller or similar device.

Generally, such reed switches are connected to external wires which lead to a controller or monitor. The connection of the reed switches to the external wires is difficult and time consuming. The known methods include soldering and mechanical fasteners. Such mechanical fasteners comprise screws tightened to contact and clamp the external wire, and displacement type connectors employing pliers to "crimp" or pinch the external wires in place.

However, a reed switch having a connector which does not require the use of tools has not previously been disclosed or employed.

2. Description of the Relevant Art

The major difficulty associated with security systems employing proximity switches discussed above is the connection of external wires or leads to the reed switch. The previously known connection methods include soldering, mechanical fasteners and construction of the reed switch with permanent wires extending therefrom. Each of these methods is time consuming, and the installation of such proximity switches is complicated.

Illustrative of known wire connection methods and apparatuses are those disclosed below.

U.S. Pat. No. 4,700,163 discloses a security system-type magnetic switch having a quick-connect switch system utilizing "push-in" sockets. The contents of the switch can be removed from the casing and replaced, but the external leads or wires must be soldered or otherwise connected to the circuit.

U.S. Pat. No. 3,652,811 discloses a switch assembly for a pushbutton switch employing clips which operatively connect the external wires to the switch assembly.

U.S. Pat. No. 4,397,514 discloses an electrical connector employing clips for securing external wires.

U.S. Pat. No. 3,715,537 discloses a hinge mounted microswitch utilized to signal when a door is open. The switch includes terminals to which external lead wires are attached.

The present invention differs from the previous designs and methods in that it provides a permanently sealed reed switch having wire trapping means for quick and easy installation of a proximity switch.

SUMMARY OF THE INVENTION

The present invention provides a security proximity switch, comprising, in combination, a reed switch being responsive to the proximity of an external magnet. The reed switch has two electrical terminals. A retaining member has the two electrical terminals therewithin. The retaining member has two tapered channels formed therewithin, each leading to an associated one of the two electrical terminals of the reed switch. A spring trap connector is disposed within each of the tapered channels. Each said tapered channel and spring trap connector facilitates the insertion therein of an external wire to connect the external wire to an associated one of the two electrical terminals without soldering and without the requirement of tools.

The present invention may suitably comprise, a proximity switch including a magnet portion and a reed switch portion. The reed switch portion may have a wire securement means enabling quick and easy connection of the proximity switch to a security system In a preferred embodiment, the reed switch portion includes a permanently sealed casing or sheath having a reed with associated circuirty and wire securement means therein.

It is an object of the present invention to provide a proximity switch having quick and easy wire securement means.

It is a further object of the present invention to provide a novel wire securement means in the reed switch portion of the proximity switch.

The above and further objects, details and advantages of the invention will become apparent from the following detailed description, when read in conjunction with the accompanying drawings.

DETAILED DESCRIPTION OF SOME PREFERRED EMBODIMENTS

Figure 1:
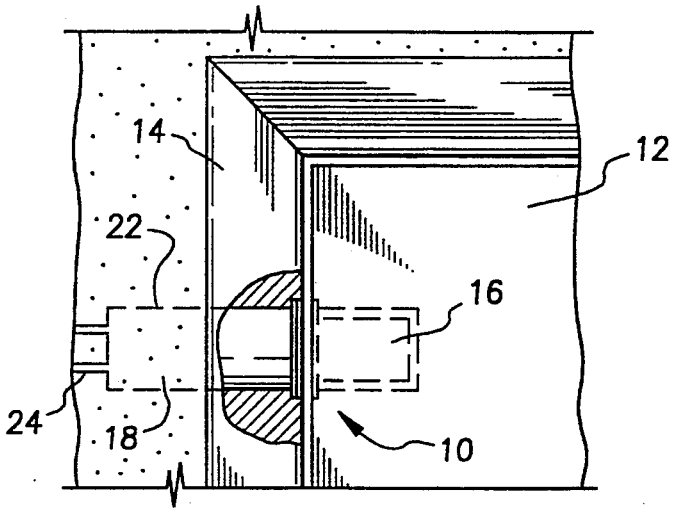
FIG. 1 illustrates a section of a door or window and related jamb portion showing the preferred arrangement of a proximity switch in accordance with the present invention.
Figure 3:
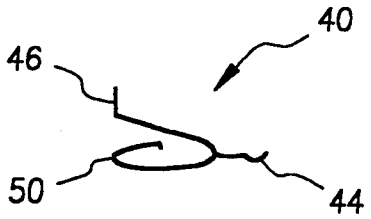
FIG. 3 illustrates a preferred embodiment of the wire securement means in accordance with the present invention.

As best seen in FIG. 1, a proximity switch 10 in accordance with the present invention may preferably, but not necessarily, be secured to a door or window or other openable member 12. The door or window 12 is generally surrounded by a jamb 14 opposite a magnet portion 16.

The magnet portion 16 and reed switch portion may preferably, but not necessarily, be secured to the door and jamb by producing a hole in the respective door and jamb and inserting the magnet portion 16 and reed switch portion 18 within the respective holes. However, such portions 16 and 18 may preferably, but not necessarily, be attached or otherwise secured to the outer portions of the door 12 and jamb 14.

The proximity switch 10 operates by the reaction caused by the movement of the magnet portion 16 away from or towards the reed switch portion 18 in conjunction with the movement of the door or window 12.

The reed switch portion 18 of FIG. 1 will be described in greater detail with reference to FIG. 2, which shows reed switch portion 18 as including a reed switch 20 comprising a reed with associated circuitry. The reed switch 20 is preferably sealed within a case or sheath 22. While the magnetic attraction of magnet portion 16 (FIG. 1) normally holds the reed of reed switch 20 in a closed position, when the magnet is moved by opening the door or window, reed switch 20 switches to an open condition and generates a signal which is received via external wires 24 (FIG. 1) by an external monitor or security system (not shown). The reed switch 20 is operatively connected to the external wires 24 by wire securement means 26. The wire securement means 26 are aligned with or within tapered channels or apertures 28 in case or sheath 22.

Figure 2:
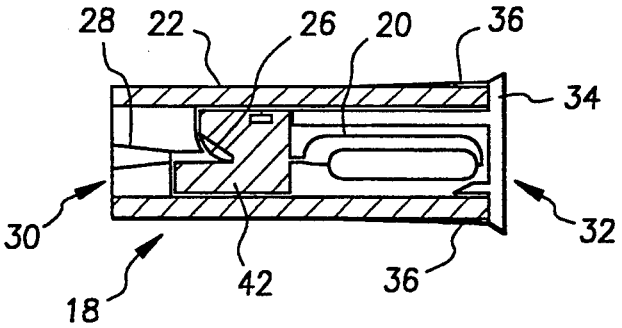
FIG. 2 illustrates a section view of the reed switch portion of the proximity switch in accordance with the present invention.
Figure 4:
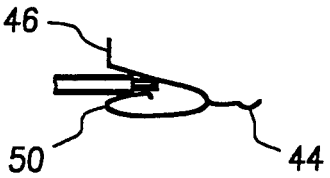
FIG. 4 illustrates the wire securement means of FIG. 3 with an external wire attached thereto.
Figure 5:
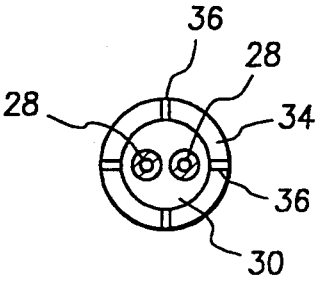
FIG. 5 illustrates a rear end view of the reed switch portion in accordance with the present invention.
Figure 6:
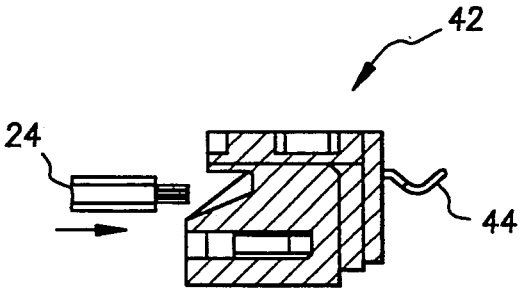
FIG. 6 illustrates the insertion of an external wire securement means of the invention.

As best seen in FIGS. 2 and 5, the aperture 28 tapers from a large diameter at the outer portion to a smaller diameter to act as a guide for a wire 24 inserted therein, to direct the wire into the proper position for securement into the wire securement means 26. The step of inserting the wire 24 into aperture 28 is shown in FIG. 6.

The case or sheath 22 may preferably, but not necessarily, be permanently sealed and includes a first or rear end 30 including apertures 28 therein. A second end 32 of case 22 includes a flange 34 and ribs 36 which act to secure the portion 18 in the jamb 14.

As best seen in FIGS. 3, 4, 5 and 6, the main portion of the wire securement means 26 comprises a spring trap connector or member 40. A pair of springs 40 may preferably, but not necessarily, be attached to a block or retaining member 42 having a V-shaped aperture or may be separately positioned within the case 22.

The spring 40 comprises a first end 44 for connection to the reed switch 20. This connection is preformed by soldering or otherwise during the production of the portion 18. A second end 46 forms a first arm of a V-shaped opening 48 into which the wire 24 is inserted. The third end 50 forms a loop and provides the pressure on the wire 24 for sufficient contact of the wire to spring 40. The spring 40 is generally oval in shape. The spring 40 is preferably one-piece and electrically conductive.

The size of the reed switch portion 18 is preferably, but not necessarily 0.375 (0.95 cm) inch in diameter and 1.25 (3.175 cm) inch in length.

Although there have been described what are at present considered to be preferred embodiments of the invention, it will be understood that various modifications and variations may be made therein, and it is intended to cover in the appended claims all such modifications as fall within the true spirit and scope of the invention.

I claim:

1. A proximity switch for a security system, said proximity switch comprising a magnet and a reed switch portion, said reed switch portion comprising:

a casing enclosing said reed switch with associated circuitry;

a least one aperture in said casing sized to accommodate an external connecting wire, one end of said wire being substantially stripped;

wire securement means adjacent said aperture, said wire securement means adapted to operatively connect said reed switch to said wire by trapping said substantially stripped end of said wire without the use of tools;

said reed switch adapted to generate a signal when not in the proximity of said magnet;

said wire securement means comprises a block-like member operatively connected at a first end to said reed switch and having trap means at an end opposite said first end aligned with said aperture; and said opposite end of said block-like member having a substantially V-shaped indent.

2. The switch of claim 1, wherein:

said casing is permanently sealed.

3. The switch of claim 1, wherein:

said wire securement means includes a pair of spring means, each said spring means comprising a generally V-shaped member having a first arm secured to a first side of said block-like member, a second arm of said V-shaped member freely extending into said V-shaped indent in said block-like member; and a clamp member on a first side opposite the side said first arm of said V-shaped member is secured and said clamp member extending through said block-like member for attachment to said reed switch to form a substantially permanent connection.

4. A proximity switch for a security system, said proximity switch comprising a magnet and a reed switch portion, said reed switch portion comprising:

a casing enclosing said reed switch with associated circuitry;

a least one aperture in said casing sized to accommodate an external connecting wire, one end of said wire being substantially stripped;

wire securement means adjacent said aperture, said wire securement means adapted to operatively connect said reed switch to said wire by trapping said substantially stripped end of said wire without the use of tools;

said reed switch adapted to generate a signal when not in the proximity of said magnet;

said wire securement means includes a pair of spring means, each said spring means comprising a generally V-shaped member having a first arm secured to a first side of a block, a second arm of said V-shaped member freely extending into a V-shaped indent in said block; and a clamp member on a first side opposite the side said first arm of said V-shaped member is secured and said clamp member extending through said block for attachment to said reed switch to form a substantially permanent connection.

5. A switch as recited in claim 4, wherein:

said casing is permanently sealed.

* * * * *

UNITED STATES PATENT AND TRADEMARK OFFICE

CERTIFICATE OF CORRECTION

PATENT NO. : 5,412,361

DATED : 02 May 1995

INVENTOR(S) : Randy L. Combest and John O. Beck

It is certified that error appears in the above-indentified patent and that said Letters Patent is hereby corrected as shown below:

Column 2, line 8, delete "said";
13th line, after "comprise" delete the comma;
20th line, change "circuirty" to --circuitry--;
50th line of print, before "securement" insert --into the wire--.
Column 3, 40th line, change "preformed" to --pre-formed--.
Column 4, line 3, change "a least" to --at least--;
line 39, change "a least" to --at least--.

Signed and Sealed this

Thirty-first Day of October 1995

*Attest:*

Bruce Lehman

BRUCE LEHMAN

*Attesting Officer*

*Commissioner of Patents and Trademarks*